US005495078A

United States Patent [19]

Stief et al.

[11] Patent Number: 5,495,078

[45] Date of Patent: Feb. 27, 1996

[54] SOUND ABSORBER

[75] Inventors: Reinhard Stief, Weinheim; Gerhard Mueller-Broll, Rimbach, both of Germany

[73] Assignee: Firma Carl Freudenberg, Weinheim, Germany

[21] Appl. No.: 147,197

[22] Filed: Nov. 3, 1993

[30] Foreign Application Priority Data

Nov. 13, 1992 [DE] Germany ..... 42 38 352.8

[51] Int. Cl.[6] ..... E04B 1/82

[52] U.S. Cl. ..... 181/295; 181/286; 446/114; 446/125

[58] Field of Search ..... 181/285, 286, 181/287, 288, 293, 294, 295; 52/275, 279, 281, 283, 284, 289; 428/158, 159, 160, 163, 167; 446/114, 125

[56] References Cited

U.S. PATENT DOCUMENTS 2,706,530 4/1955 Abrams ..... 181/295
4,755,408 7/1988 Noël ..... 428/159 X

*Primary Examiner*—Michael L. Gellner
*Assistant Examiner*—Eddie C. Lee
*Attorney, Agent, or Firm*—Kenyon & Kenyon

[57] ABSTRACT

Free-standing sound absorber consisting of an open-cell foam body designed in the manner of a board, having at least one opening in a lateral face for plugging together another, similarly designed foam body. The opening has a height corresponding approximately to half the height of the foam body. The depth of the opening corresponds to the thickness of the foam body.

16 Claims, 4 Drawing Sheets

SOUND ABSORBER

FIELD OF THE INVENTION

The invention relates to a sound absorber consisting of an open-cell foam body, and more particularly to free-standing sound absorbers.

BACKGROUND OF THE INVENTION

Free-standing sound absorbers are generally known in various embodiments. The sound absorbers usually have a cubic or cylindrical shape and are provided with holding devices for fastening them, for example, to hall ceilings. However, the absorption surface is relatively small in comparison to the enclosed space and the effectiveness of the individual sound absorber is therefore not very satisfactory.

SUMMARY AND ADVANTAGES OF THE INVENTION

An object of the invention is to provide an enlarged absorption surface relative to the overall size of the sound absorber, and, associated with this, to improve sound absorption properties and allow for better adaption to a particular application.

The present invention therefore provides a sound absorber comprising at least one open-celled foam body having a height, a width and a thickness, the foam body having at least one opening for plugging together with another similarly designed foam body; the opening having a height which corresponds to approximately half the height of the foam body and a depth which corresponds to the thickness of the foam body.

The foam body is designed in the manner of a board with at least one opening in a lateral face. The opening is designed so that it may be fitted together with another, similarly designed foam body. The opening therefore has a height which corresponds to approximately half the height of the foam body and a depth which corresponds to the thickness of the foam body.

An advantage of the invention is that, in comparison with cubic sound absorbers with the same dimensions, an enlargement of the absorption surface by a factor of 1.5 to 10 results. Thus, the large absorption surface allows either more effective sound absorption for the same overall size or significantly smaller dimensions of a sound absorber with the same effectiveness.

A further advantage is that with the multi-part plug-together design, large free-standing sound absorber units can be transported simply. The free-standing sound absorber can be adapted especially well to the particular circumstances of the application case by plugging together the individual foam bodies.

A still further advantage is that the dimensioning of the openings permits a durable, friction-locking and positive-locking joining of the entire free-standing sound absorber after assembly of the individual foam body slabs.

In an advantageous, simple design, the foam body may have a height and width which substantially correspond. From this it follows that the free-standing sound absorber, formed for example from four foam bodies which can be plugged together, has essentially cubic external dimensions and therefore can be mounted in any position at its intended location with the same effectiveness.

Two openings which extend parallel to one another and have a corresponding design can be provided in the foam body on one side. As a result, matching the free-standing sound absorber to a particular application is especially simple. Due to the substantial correspondence of height and width and the preferably corresponding design of the openings, the individual elements from which the free-standing sound absorber is assembled can be connected to one another in any form and number. Stocking of individual elements also can be simplified in that the individual elements need not differ in their dimensions, but rather can consist of foams of mutually differing density. It is also advantageous that the free-standing sound absorber may be aligned spatially at its intended location to permit simultaneous absorption of sound vibrations of different frequency from different directions.

The openings can be provided on the delimiting faces facing one another with at least one clearance cut in each case. This design produces a simple and problem-free assembly of the plug-together slab bodies made of foam. Plugging together takes place by slightly enlarging the opening elastically until the two foam bodies are completely plugged together. Due to the clearance cut, the use of a lubricant during the assembly is unnecessary and compression of the surface of the material of the foam body, which may lead to damage, is reliably prevented.

The clearance cut can have a height which is 0.5 to 0.9, preferably 0.65 to 0.76, times as large as the height of the opening and a depth which corresponds to the thickness of the foam body, the clearance cut being delimited in its height on both sides by a shoulder projecting towards the opposite delimiting face. To allow easy manufacture, one clearance cut is preferably provided on each delimiting face. A number differing therefrom, for example two clearance cuts, provides, for a somewhat higher production outlay and a minimally more complicated assembly, improved guidance and support of the two foam bodies with respect to one another in the assembled state of the free-standing sound absorber. The foam bodies are held in the region of the projecting shoulders after plugging together. For easier assembly and to avoid a clasping of the two foam bodies before the joining process is complete, the shoulders can, for example, be rounded or be designed in the form of an insertion bevel.

The foam bodies can be provided with a holding device on at least one of their end sides. The holding device on the one hand provides an additional joining of the foam bodies fixed on one another and on the other hand permits a fastening of the elastically resilient free-standing sound absorber to walls or ceilings.

The free-standing sound absorber is preferably used as a ceiling absorber. The ceiling absorber can be suspended vertically or horizontally. When fashioned a ceiling absorber, a holding device in each case may be provided in the region of the two end sides. The holding devices are, in an advantageous development, supported against one another. It is of advantage here that the foam bodies are not subject to tensile and flexural loading. The holding plates can be provided with hooks and eyes, so that a plurality of free-standing sound absorbers can be fastened to the ceiling in the form of a chain. The resulting forces are transmitted via the holding plates and via the rod system connecting the holding plates so that the foam bodies are not subject to loads which reduce service life.

BRIEF DESCRIPTION OF THE DRAWINGS

Two exemplary embodiments of the free-standing sound absorber according to the invention are explained in greater detail below with the aid of the following drawings.

DETAILED DESCRIPTION

Figure 1:
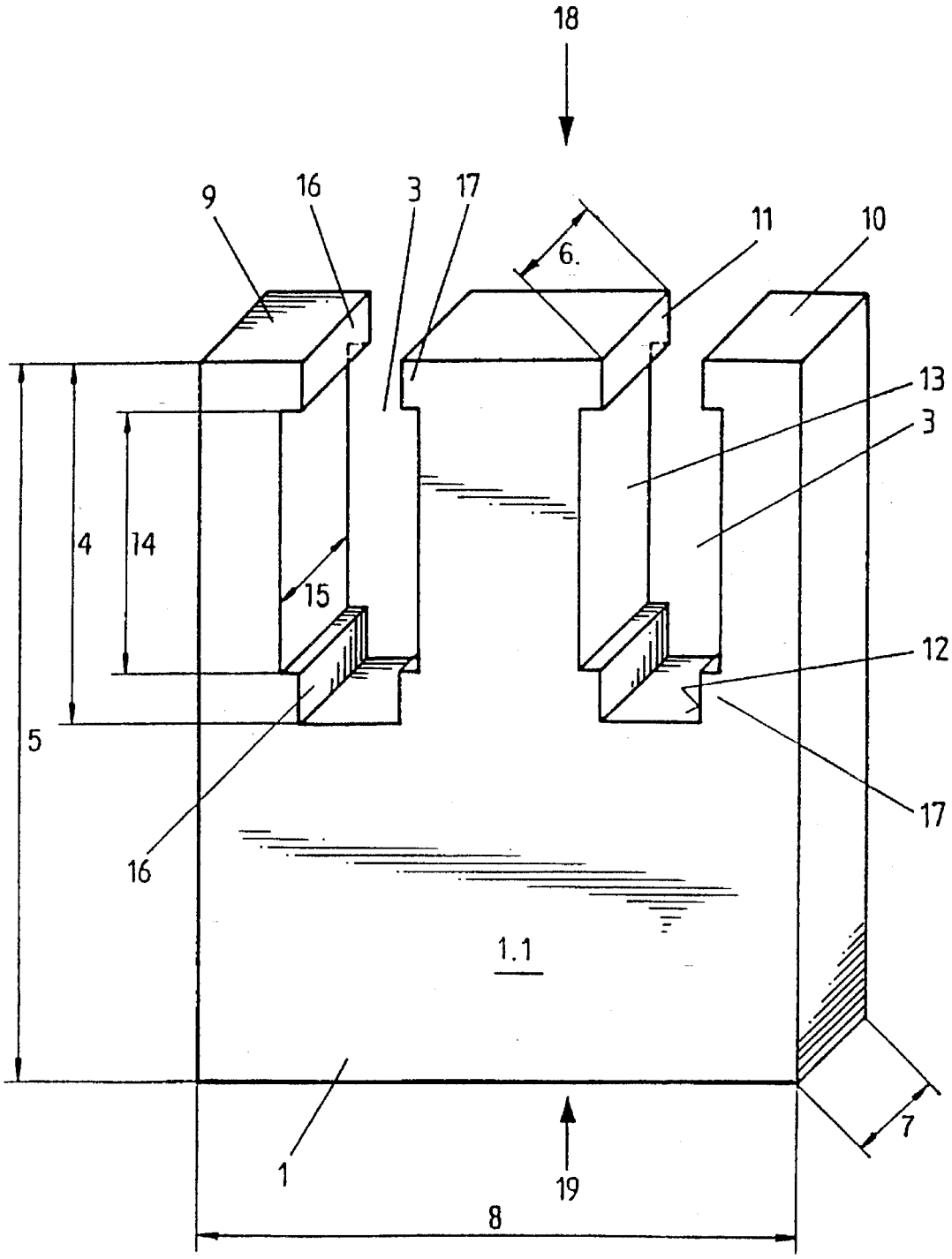
FIG. 1 shows an open-cell foam body which is designed in the manner of a board.

FIG. 1 shows a foam body 1 as a slab element which can be attached to a plurality of foam bodies of similar design to form a free-standing sound absorber. Each foam body 1 has an open-cell structure and is designed in the manner of a board. Both openings 3 in this embodiment correspond in their shape. The openings 3 penetrate the entire thickness 7 of the foam body 1 and have a corresponding depth 6. The height 4 of the openings 3 corresponds to half the height 5 of the foam body 1. The openings 3 have delimiting faces 11 and 12 facing one another. In order to simplify assembly of the foam bodies, the openings 3 are provided on each of the delimiting faces 11, 12 with a clearance cut 13. By means of this design, assembly is simplified, since the surfaces no longer contact one another over the entire delimiting face during plugging together. The fixing of the foam bodies on one another takes place in this exemplary embodiment only via shoulders 16, 17, specifically by friction-locking. The foam body 1 shown here is intended to be assembled with three further, similarly designed foam bodies to form a unit.

Figure 2:
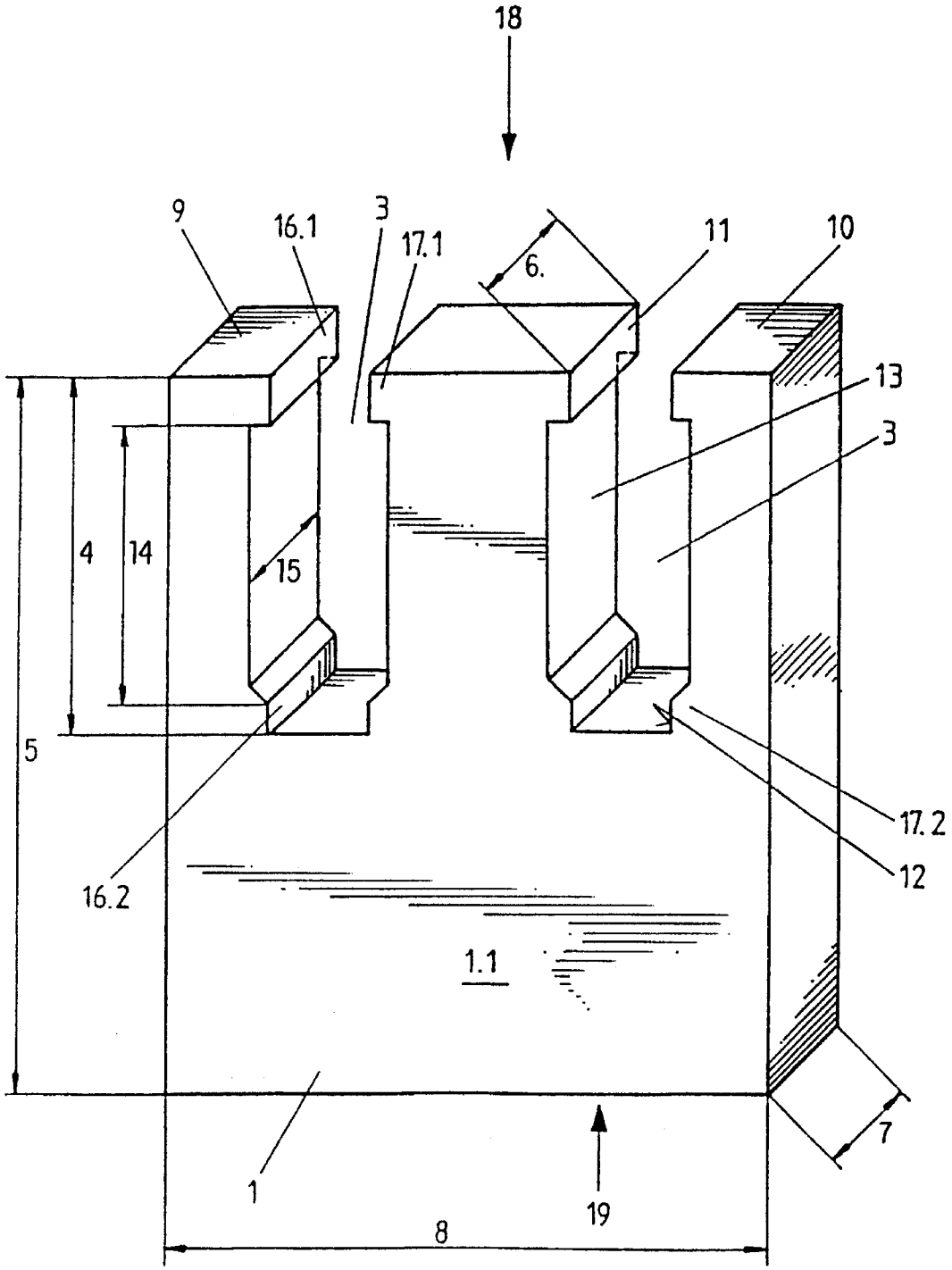
FIG. 2 shows an open-cell foam body similar to that shown in FIG. 1 but with differently designed openings.

FIG. 2 shows a foam body 1 which is designed in a similar manner to that from FIG. 1. The only difference can be seen in the shape of the openings 3. The shoulders 16, 17 are designed to be sharp-edged and projecting at a right angle on the side 18 facing the orifice of the opening 3. On the opposite end side 19, the shoulders are beveled in the region of their transition to the delimiting faces 11, 12. A different design from this, for example a rounded transition, is also conceivable. This design has, compared with the shape shown in FIG. 1, the advantage of simplified assembly. The foam bodies, which can be plugged into one another, are guided into their final position by means of the beveled transition between the clearance cut 13 and the delimiting faces 11, 12. Jamming and unnecessary adjustment of the foam bodies in their position with respect to one another can thereby be prevented during the assembly. In contrast to this, the shoulders 16.1, 17.1 starting from the clearance cut 13 have a sharp-edged transition into the delimiting faces 11, 12. This design produces a barb effect when the plugged-together foam bodies are subject to a load counter to the assembly direction. This design therefore simplifies handling.

Figure 3:
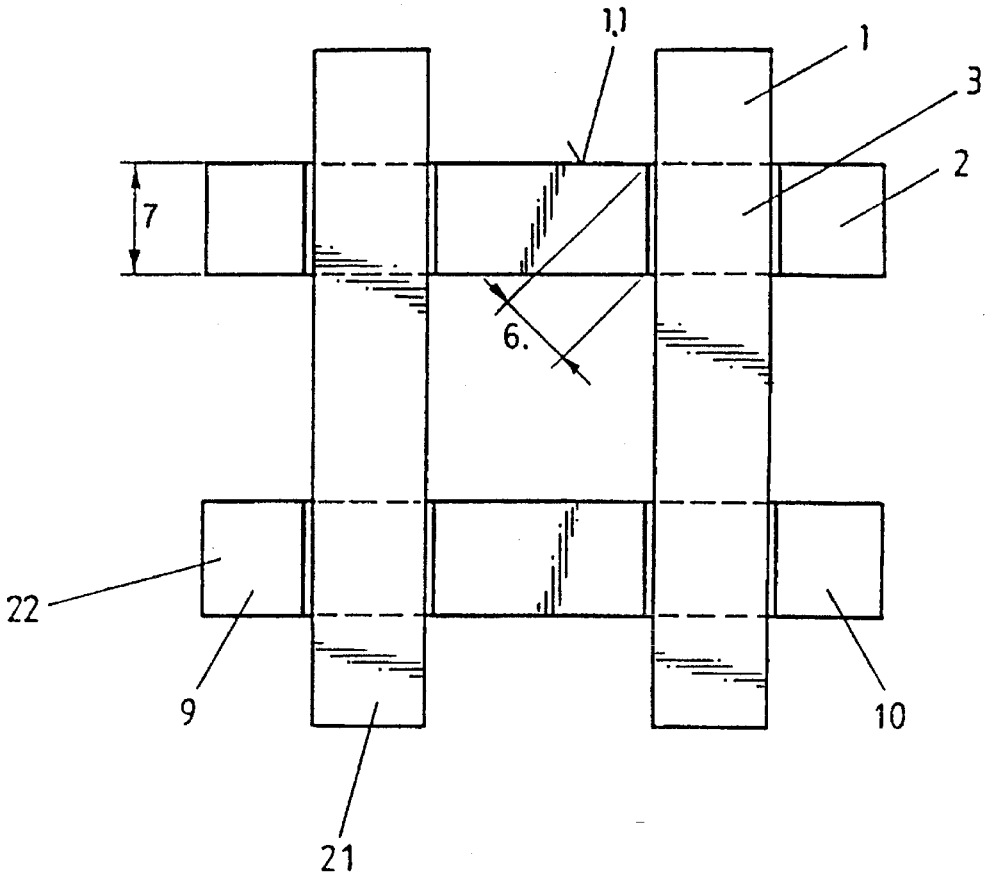
FIG. 3 shows the foam bodies according to FIGS. 1 and 2 in each case assembled to form a free-standing sound absorber and shown in a plan view.

FIG. 3 shows a free-standing sound absorber consisting of four similar foam bodies 1, 2, 21, 22 shown in an assembled state. The slab-shaped foam bodies are in each case plugged together in the region of their openings 3.

Figure 4:
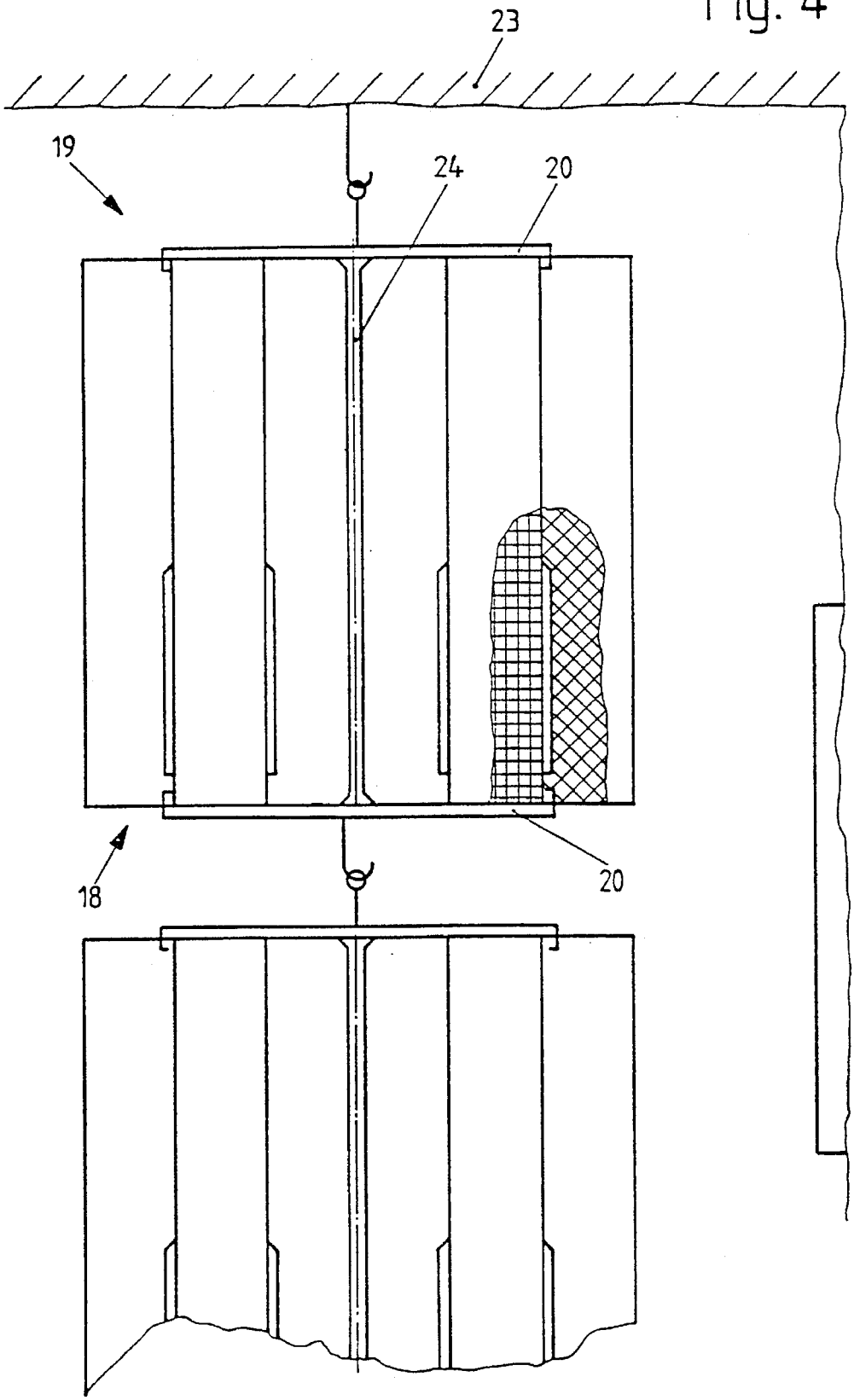
FIG. 4 shows the use of the free-standing sound absorber as a ceiling absorber.

FIG. 4 shows the free-standing sound absorber as a ceiling absorber. The slab-shaped foam bodies are plugged together to form a structure according to FIG. 3 and fastened by means of holding plates 20 at in each case one end side 18, 19 on a ceiling 23 shown diagrammatically. The holding plates 20 can consist, for example, of light metal and be joined to one another by a connecting brace 24. By means of this design, the foam bodies are subjected to load only by their intrinsic weight, which is of benefit both to their service life and also to their service properties. The holding plates 20 are provided with eyes on the side facing the one end side 19 and with hooks on the opposite end side 18. Due to this design, a plurality of free-standing sound absorbers according to the invention can be joined to one another. If the ceiling 23 consists, for example, of a saddleback roof, with this design the entire roof ridge can be filled with the free-standing sound absorbers according to the invention. In FIG. 4, two free-standing sound absorbers are fastened to the ceiling 23 in the manner of a chain, whereas the free-standing sound absorbers of the adjacent chain are arranged staggered with respect thereto. By means of this design, overall effectiveness is improved and mutual influencing of the free-standing sound absorbers is less.

What is claimed is:

1. A sound absorber comprising:

at least one open-celled foam body having a height, a width, and a thickness, the foam body having at least one opening;

the opening having a height half the height of the foam body and a depth and a width which are equal to the thickness of the foam body.

2. The sound absorber as recited in claim 1 wherein the height and width of the foam body are the same.

3. The sound absorber as recited in claim 1, wherein the foam body has at least two openings, the openings extending parallel to one another.

4. The sound absorber as recited in claim 3 wherein the height and width of the foam body are the same.

5. The sound absorber as recited in claim 3 wherein each opening has two delimiting faces facing one another, and further comprising a clearance cut provided in at least one of the delimiting faces.

6. The sound absorber as recited in claim 3 further comprising a holding device on at least one side of the foam body.

7. The sound absorber as recited in claim 1, wherein the opening has two delimiting faces facing one another, and further comprising a clearance cut provided in at least one of the delimiting faces.

8. The sound absorber as recited in claim 7 wherein the clearance cut has a height which is 0.5 to 0.9 times as large as the height of the opening and a depth which corresponds to the thickness of the foam body.

9. The sound absorber as recited in claim 7 wherein the clearance cut in the delimiting face is limited on both sides by a shoulder projecting towards the opposite delimiting face.

10. The sound absorber as recited in claim 7 further comprising a holding device on at least one side of the foam body.

11. The sound absorber as recited in claim 1 further comprising a holding device on at least one side of the foam body.

12. A sound absorber comprising:

at least one open-celled foam body having a height, a width and a thickness, the foam body having at least one opening;

the opening having a height half the height of the foam body and a depth which is, the opening having two delimiting faces facing one another; and a clearance cut in at least one of the delimiting faces.

13. The sound absorber as recited in claim 12 wherein the clearance cut has a height which is 0.5 to 0.9 times as large as the height of the opening and a depth equal to the thickness of the foam body.

14. The sound absorber as recited in claim 12 wherein the clearance cut in the delimiting face is limited on both sides by a shoulder projecting towards the opposite delimiting face.

15. The sound absorber as recited in claim 12 wherein the foam body has at least two openings.

16. A sound absorber comprising:

at least two open-celled foam bodies, each body having a height, a width, and a thickness, each foam body having at least one opening;

each opening having a height half the height of each foam body and a depth and a width which are equal to the thickness of each foam body; and the at least two foam bodies being connected together at their respective openings in a perpendicular relationship to one another.

* * * * *